US007882986B2

(12) United States Patent
Huang et al.

(10) Patent No.: US 7,882,986 B2
(45) Date of Patent: Feb. 8, 2011

(54) LIQUID DISPENSER

(76) Inventors: Yi-Chung Huang, No. 32, Alley 12, Lane 85, Chunghwa W. St., Tainan Hsien, Yungkang City (TW); Yu-Jung Huang, No. 32, Alley 12, Lane 85, Chunghwa W. St., Tainan Hsien, Yungkang City (TW)

( * ) Notice: Subject to any disclaimer, the term of this patent is extended or adjusted under 35 U.S.C. 154(b) by 833 days.

(21) Appl. No.: 11/895,558

(22) Filed: Aug. 24, 2007

(65) Prior Publication Data

US 2009/0050652 A1 Feb. 26, 2009

(51) Int. Cl.
*B65D 37/00* (2006.01)

(52) U.S. Cl. ..... 222/209; 222/333

(58) Field of Classification Search ..... 222/209, 222/333, 400.7, 400.8, 401
See application file for complete search history.

(56) References Cited

U.S. PATENT DOCUMENTS

| | | | | |
|---|---|---|---|---|
| 3,173,584 | A * | 3/1965 | Giavasis | 222/263 |
| 4,116,366 | A * | 9/1978 | Takenakashima et al. | 222/131 |
| 4,310,104 | A * | 1/1982 | Takatsuki | 222/131 |
| 6,035,646 | A * | 3/2000 | Griswold | 62/50.1 |
| 6,401,985 | B1 * | 6/2002 | DeMars | 222/209 |

* cited by examiner

*Primary Examiner*—Kevin P Shaver
*Assistant Examiner*—Robert K Nichols, II
(74) *Attorney, Agent, or Firm*—C. G. Mersereau; Nikolai Mersereau, P.A.

(57) ABSTRACT

A liquid dispenser is mounted on a container and has a shell, a spout assembly, an injection assembly, a power pack and an activating assembly. The shell is mounted on the container and has an injection tube. The spout assembly is formed on and protrudes from the shell. The injection assembly is mounted in the shell pumps air into the injection tube to force liquid from the spout assembly. The activating assembly selectively activates the injection assembly and selectively seals or opens an air passage to the injection tube.

8 Claims, 9 Drawing Sheets

LIQUID DISPENSER

BACKGROUND OF THE INVENTION

1. Field of the Invention

The present invention relates to a liquid dispenser, and more particularly to a liquid dispenser mounted on a container and dispensing liquid from the container precisely and easily.

2. Description of Related Art

Conventional liquid dispensers may be manual or automatic, are mounted on a container holding a liquid and having a top and a bottom and usually comprise a top, a spout, a push button, an air pump, an discharge tube and a pick-up tube. The push button is mounted on the top of the liquid dispenser. The spout protrudes transversely from the liquid dispenser and has an inner end. The air pump is mounted in the liquid dispenser below the push button and is operated and expels air into the container by pressing the push button. The discharge tube is connected to and communicates with the bottom of the air pump. The pick-up tube is connected to the liquid dispenser and extends to the bottom of the container so liquid in the container is forced into the pick-up tube and out the spout by increased air pressure on the liquid when the air pump pumps air into the container. However, when a person stop pressing the push button, residual air pressure in the container forces additional liquid to be discharged from the spout that wastes liquid and causes the area around the container to be messy.

Furthermore, the liquid dispenser has a specific size and can be mounted only on a corresponding container and cannot be mounted on a container with a larger or smaller mouth.

To overcome the shortcomings, the present invention provides an electric liquid dispenser to mitigate or obviate the aforementioned problems.

SUMMARY OF THE INVENTION

The main objective of the present invention is to provide a liquid dispenser for a container to dispense liquid from the container precisely and easily.

The liquid dispenser in accordance with the present invention is mounted on a container having a mouth and a bottom and comprises a shell, a spout assembly, an injection assembly, a power pack and a switching group. The shell is mounted on the mouth of the container and has an injection tube. The spout assembly has a spout and a pick-up tube. The spout is formed on and protrudes transversely from the shell and is connected to the injection tube. The pick-up tube communicates with the spout and extends to the bottom of the container. The injection assembly is mounted in the shell, pumps air into the injection tube. The pressure release tube is mounted in the shell and is connected to the injection tube. The activating assembly is mounted on the shell, is electrically connected to the power pack, activates the injection assembly and selectively releases pressurized air in the container when the injection assembly is deactivated.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
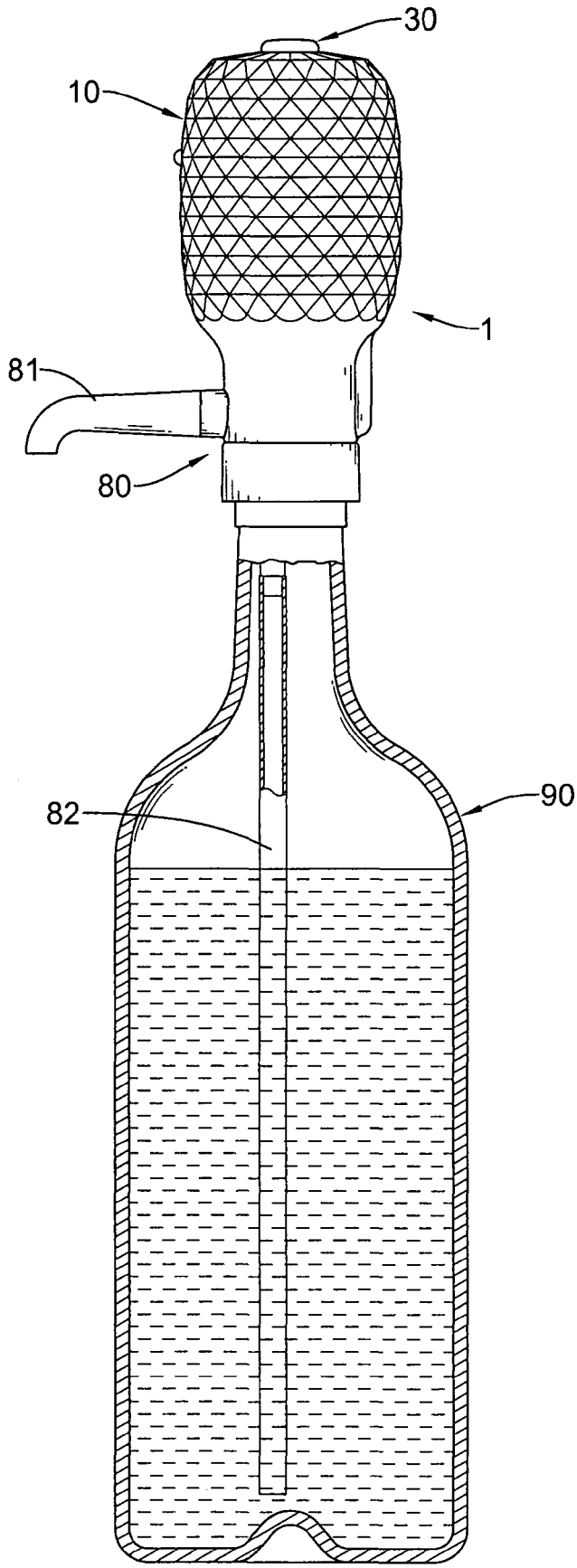
FIG. 1 is a partial cross section side view of a liquid dispenser in accordance with the present invention mounted on a container.
Figure 2:
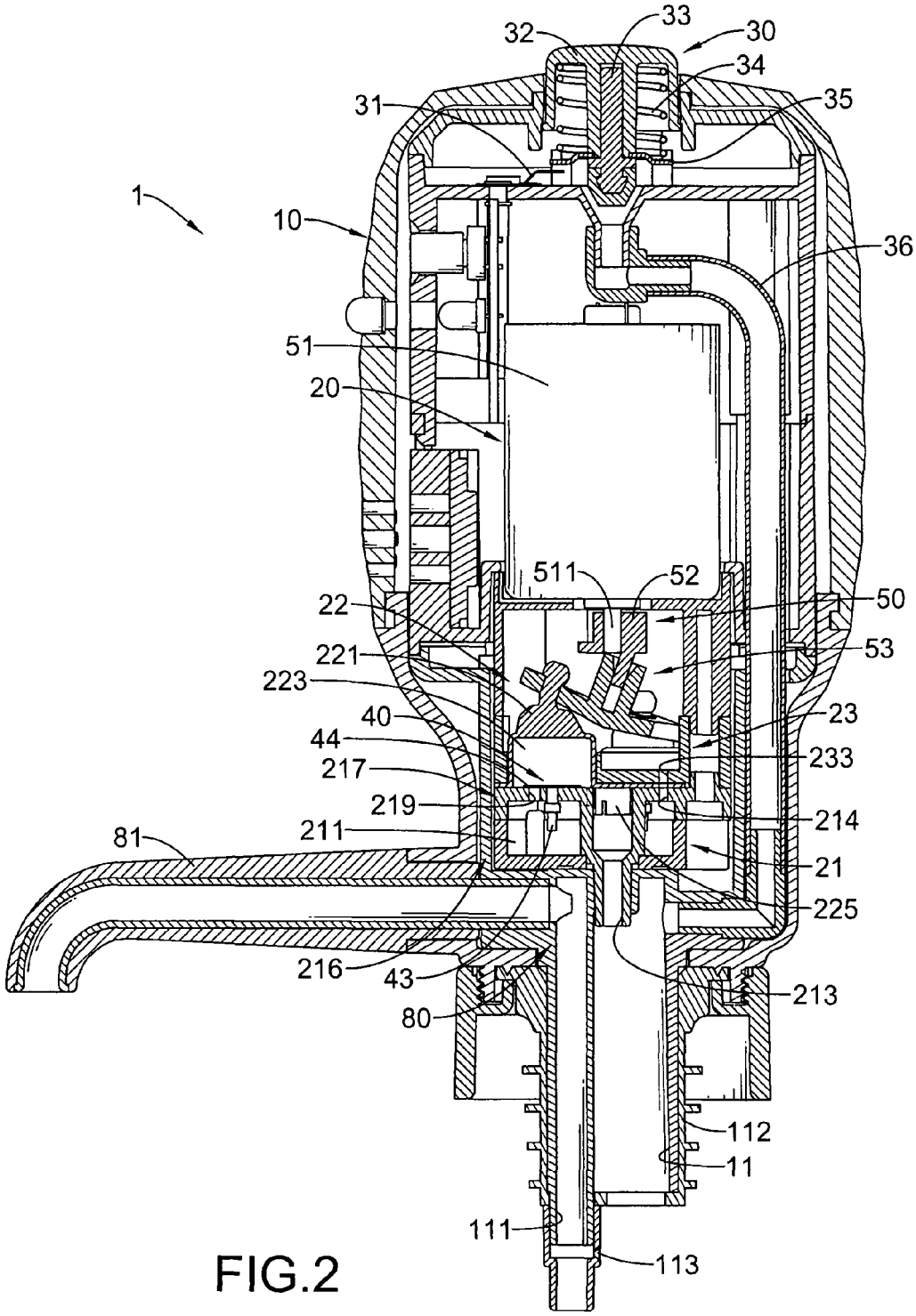
FIG. 2 is an enlarged cross section side view of the liquid dispenser in FIG. 1.
Figure 5:
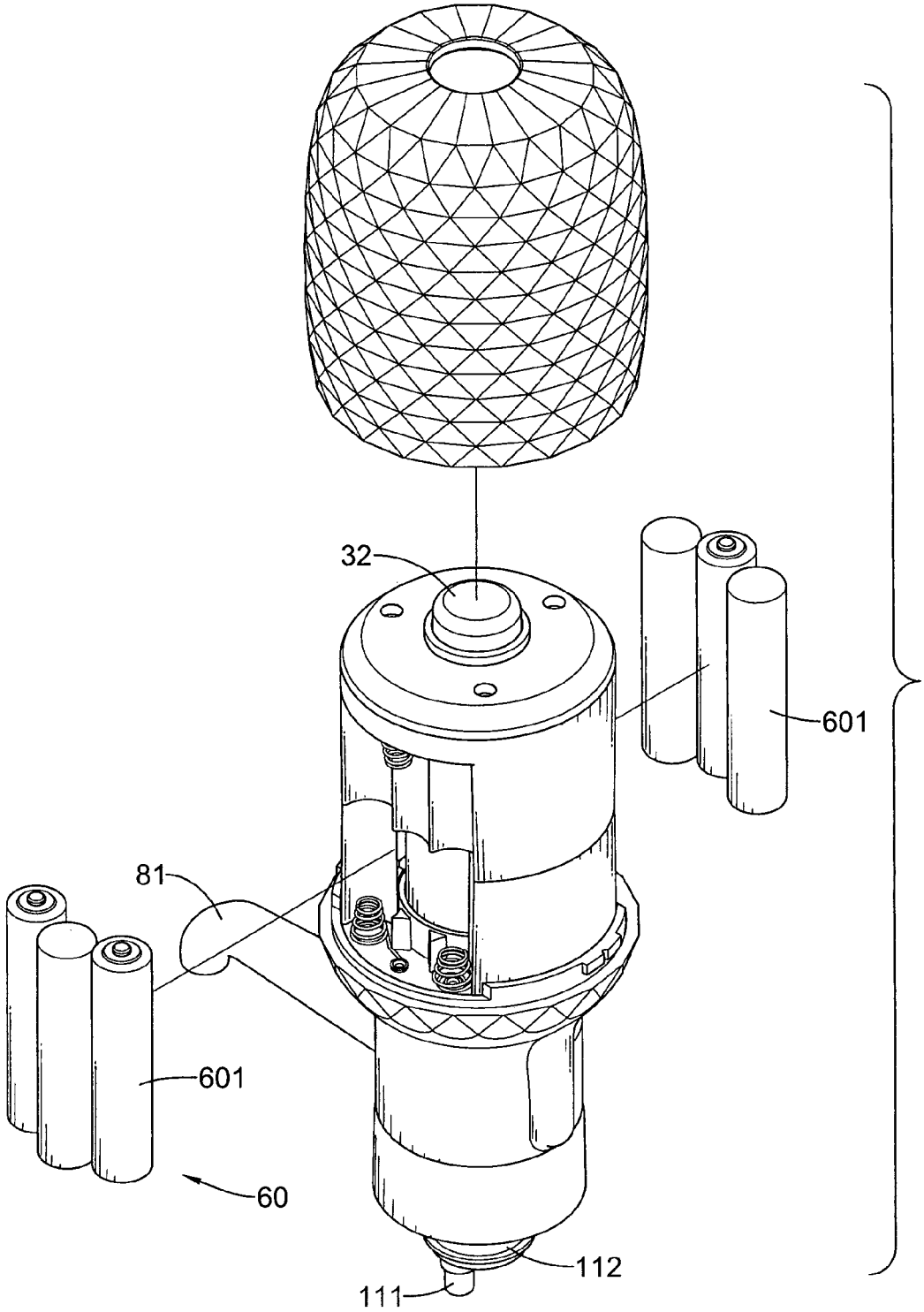
FIG. 5 is a partially exploded perspective view of the liquid dispenser in FIG. 1.

With reference to FIGS. 1, 2 and 5, a liquid dispenser (1) in accordance with the present invention is mounted on a container (90) having a top, a bottom and a mouth and comprises a shell (10), a spout assembly (80), an injection assembly (20), a power pack (60) and an activating assembly (30).

The shell (10) is hollow, is mounted on the mouth at the top of the container (90) and has a bottom, a top end, an injection tube (11) and multiple air ports. The injection tube (11) is formed on and protrudes longitudinally from the bottom of the shell (10) and has an internal surface, an external surface, an upper end, a discharge tube (111), an optional gasket (112) and an optional gas hole (113).

The discharge tube (111) is formed longitudinally on the internal surface of the injection tube (11) and has a top end and a bottom end.

The gasket (112) is mounted around the external surface of the injection tube (11) and presses against and seals the mouth of the container (90).

The gas hole (113) is formed transversely through the discharge tube (111) near the bottom end to inject air into liquid passing through the discharge tube (111).

The air ports are formed through the shell (10) between the bottom and the top end.

The spout assembly (80) is connected to and communicates with the discharge tube (111) of the injection tube (11) and has a spout (81) and a pick-up tube (82).

The spout (81) is mounted on and protrudes from the shell (10) below the air ports, is connected to and communicates with the injection tube (11) near the upper end of the injection tube (11) and has an inner end and an outer end. The inner end of the spout (81) is connected to the upper end of the injection tube (11) and communicates with the discharge tube (111). The outer end of the spout (81) protrudes from the shell (10).

The pick-up tube (82) is connected to and extends longitudinally from the bottom end of the discharge tube (111) and has an upper end and a lower end. The upper end connects to and communicates with the discharge tube (111). The lower end is open and near the bottom of the container (90).

Figure 3:
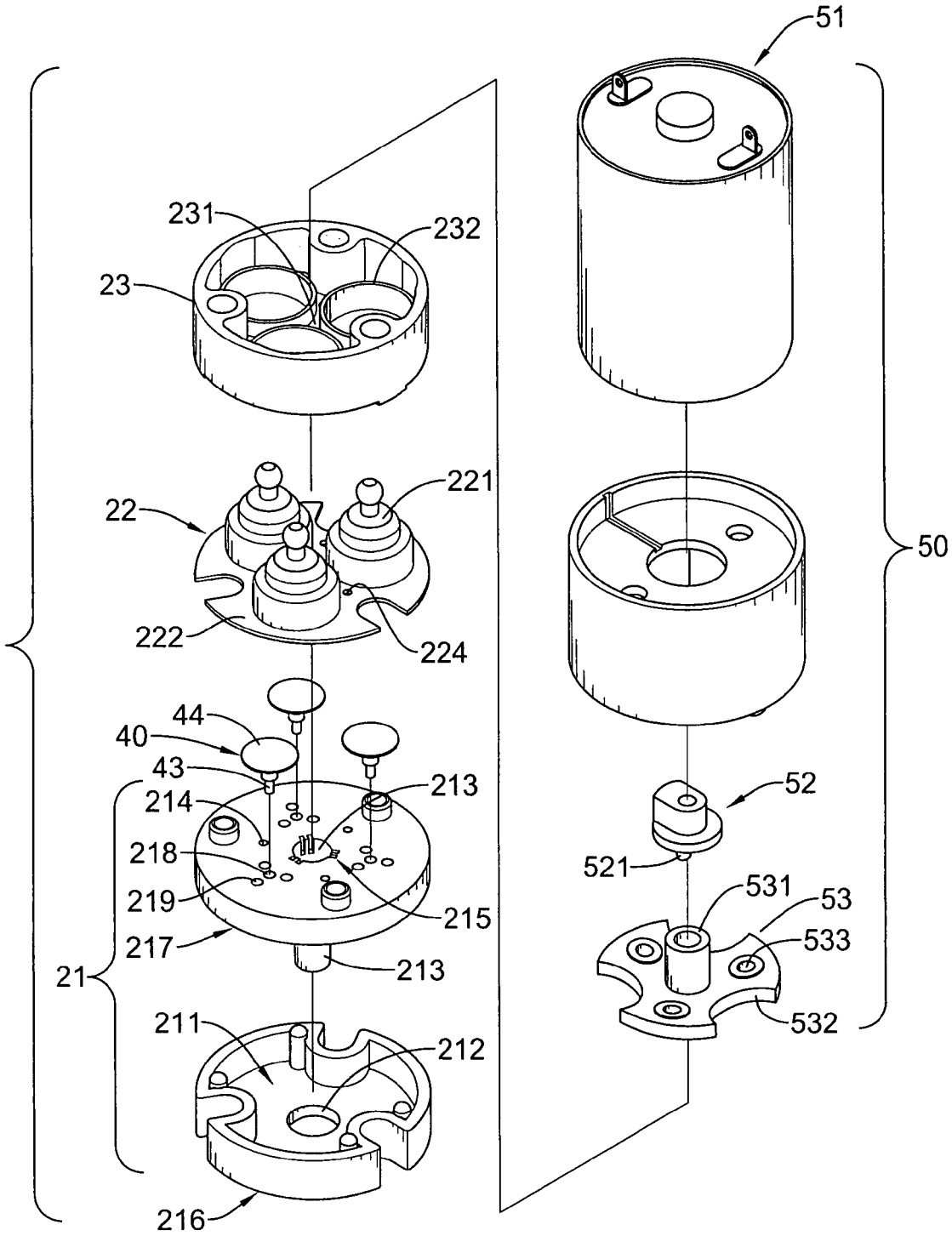
FIG. 3 is an exploded perspective view of an injection assembly of the liquid dispenser in FIG. 1.
Figure 4:
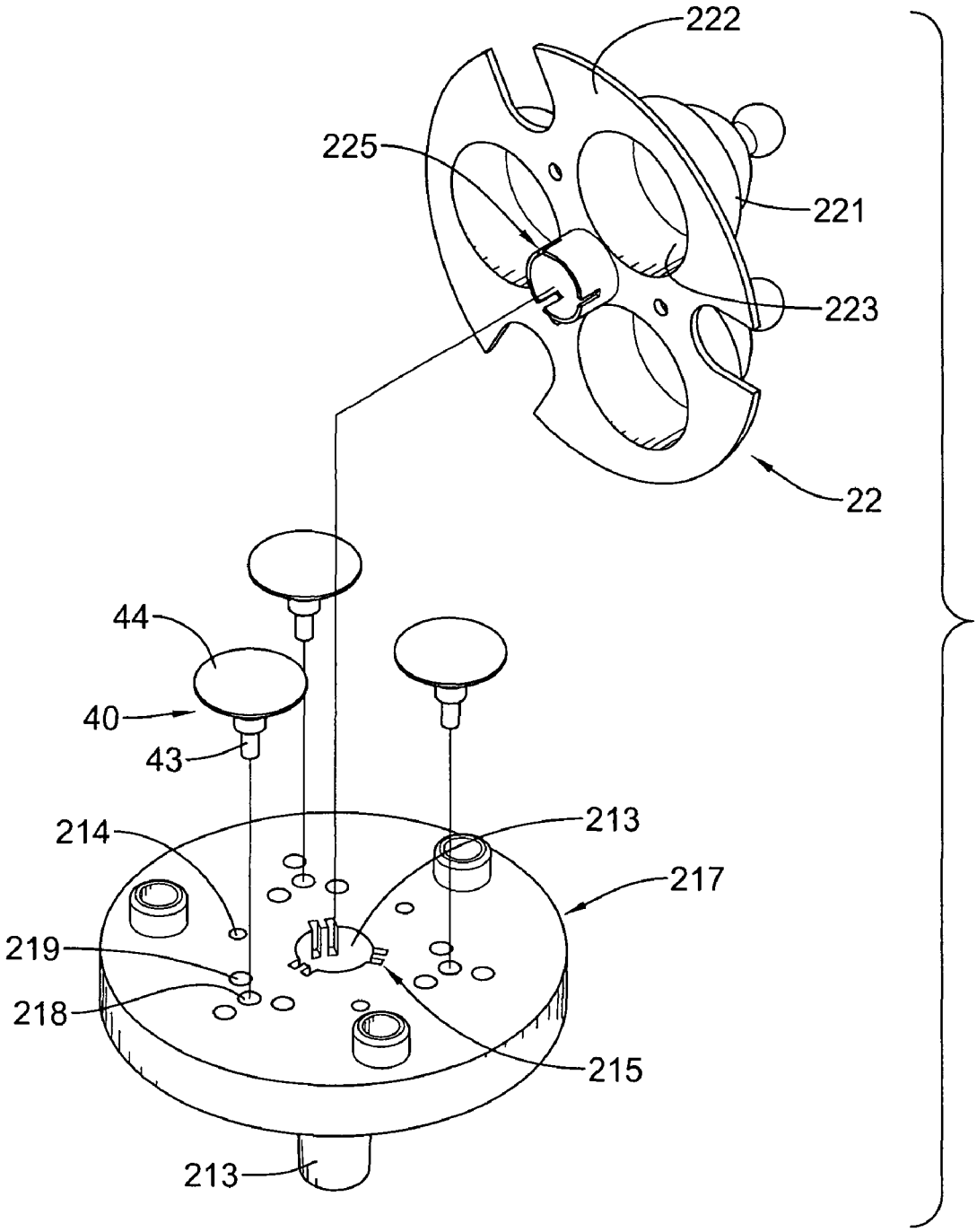
FIG. 4 is an enlarged exploded perspective view of the injection assembly of the liquid dispenser in FIG. 3.

With further reference to FIGS. 3 and 4, the injection assembly (20) is mounted in the shell (10) and pumps air into the injection tube (11) to increase air pressure in the container (90) above the liquid to force the liquid through the pick-up tube (82) and the discharge tube (111) and out the spout (81). The injection assembly (20) may be implemented with a base (21), an air pump (22), an optional cap frame (23) and a drive device (50).

The base (21) is connected to the injection tube (11) above the spout (81) and has a lower segment (216), an upper segment (217) and multiple inlet check valves (40).

The lower segment (216) is mounted in the shell (10) against the upper end of the injection tube (11) and has a bottom, an air chamber (211) and a central hole (212). The air chamber (211) is formed in the lower segment (216). The central hole (212) is formed through the bottom of the lower segment (216) and corresponds to and communicates with the upper end of the injection tube (11).

The upper segment (217) is mounted on the lower segment (216) and has a center, an upper surface, an outlet tube (213), multiple ventilating holes (214), multiple outlet channels (215), multiple optional disk mounting holes (218) and multiple optional inlet holes (219). The outlet tube (213) is formed on and protrudes down from the center of the upper segment (217), extends through the central hole (212) in the lower segment (216), is mounted in the upper end of the injection tube (11) and has an upper edge and an inner surface. The ventilating holes (214) are formed through the upper segment (217) around the center. The outlet channels (215) are formed longitudinally in the inner surface of the outlet tube (213) and communicate with the upper edge. Each disk mounting hole (218) is formed through the upper segment (217) between adjacent ventilating holes (214). The inlet holes (219) are formed through the upper segment (217) in clusters respectively around corresponding disk mounting holes (218).

The inlet check valves (40) are connected to the upper segment (217), allow air to flow from the air chamber (211) through the inlet holes (219) and keep air from flowing back through the inlet holes (219) into the air chamber (211). Each inlet check valve (40) has a neck (43) and a resilient disk (44). The necks (43) are mounted respectively in the disk mounting holes (218) in the upper segment (217), and each neck (43) has a top end. The resilient disks (44) are formed respectively on the top ends of the necks (43), are mounted against the upper surface of the upper segment (217) and cover the inlet holes (219).

The air pump (22) is mounted on the base (21), pumps air into the container (90) through the injection tube (11) to increase air pressure in the container (90) and force liquid in the container (90) out through the spout assembly (80) and has a basal disk (222), multiple suction caps (221), multiple ventilating holes (224) and an outlet check valve (225).

The basal disk (222) is mounted on the upper segment (217) of the base (21) and has a center, a top surface, a bottom surface and multiple through holes. The through holes are formed around the center of the basal disk (222), correspond respectively to, are slightly larger than and are mounted respectively over the resilient disks (44) of the inlet check valve (40) and have an edge.

The suction caps (221) are resilient, are formed respectively on the edges of the through holes of the basal disk (222), protrude from the top surface of the basal disk (222), draw air from the air chamber (211) when extending and pump air into the outlet tube (213) when being compressed. Each suction cap (221) has a head and a compression chamber (223). The compression chamber (223) is formed inside a corresponding suction cap (221) and covers a corresponding inlet check valve (40).

The ventilating holes (224) are formed through the basal disk (222) and align with the ventilating holes (214) in the upper segment (217) of the base (21).

The outlet check valve (225) is tubular and resilient, is formed on and protrudes from the bottom of the basal disk (222), corresponds to and is mounted in the outlet tube (213) and has a distal end, multiple longitudinal slots and multiple curved longitudinal flaps. The longitudinal slots are formed through the outlet check valve (225) and communicate with the distal end. The curved longitudinal flaps are formed respectively between adjacent longitudinal slots and are mounted respectively over and close the outlet channels (215) to keep pressurized air in the container (90) from being drawn into the air pump (22) when the suction caps (221) extend.

The cap frame (23) is connected securely to the upper segment (217) on the air pump (22) and has a bottom panel (231), multiple mounting rings (232) and multiple ventilating holes (233). The bottom panel (231) is mounted on the top surface of the basal disk (222) of the air pump (22) and has a top surface and multiple mounting holes. The mounting holes are formed through the bottom panel (231) and correspond respectively to and are mounted respectively around the suction caps (221) of the air pump (22), and each mounting hole has an edge. The mounting rings (232) are formed on the bottom panel (231) respectively around the edges of the mounting holes, protrude up from the top surface of the bottom panel (231), overlap the outlet channels (215) of the outlet tube (213) and are mounted respectively around and hold the suction caps (221). The ventilating holes (233) are formed through the bottom panel (231) and align with the ventilating holes (224) of the basal disk (222).

Figure 6:
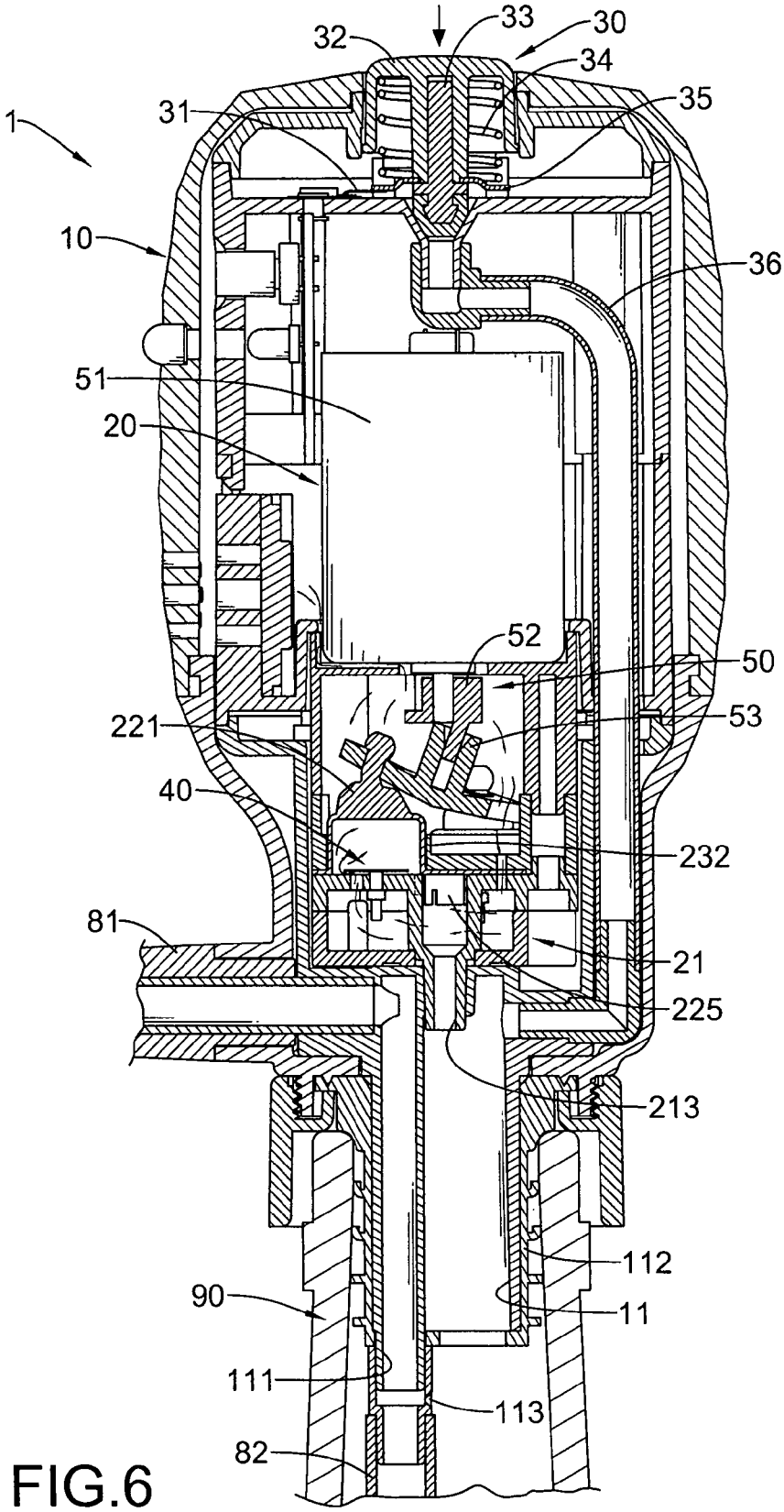
FIGS. 6 and 7 are operational cross section side views of the liquid dispenser in FIG. 1 with air being injected into the container.
Figure 7:
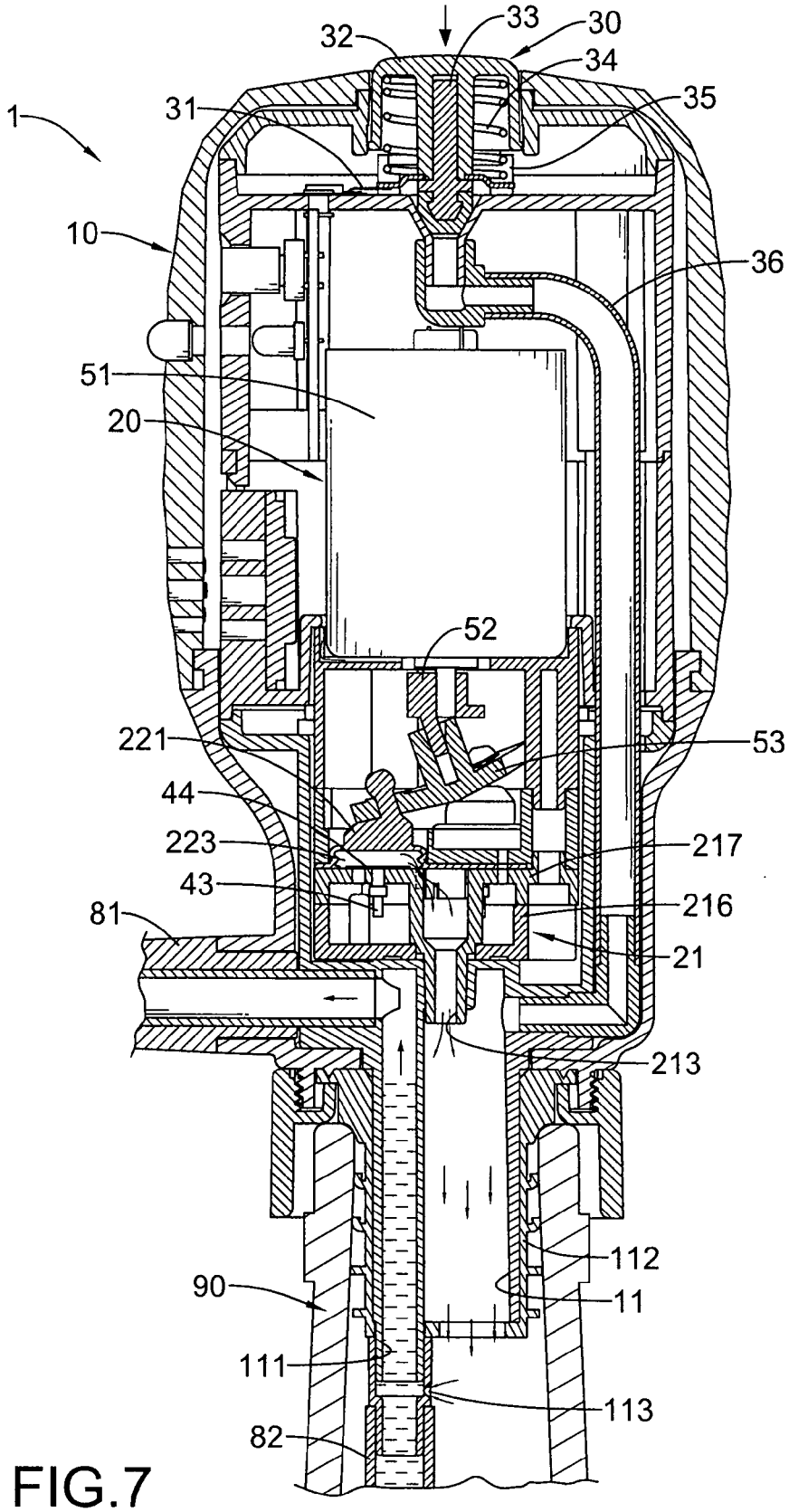
Figure 8:
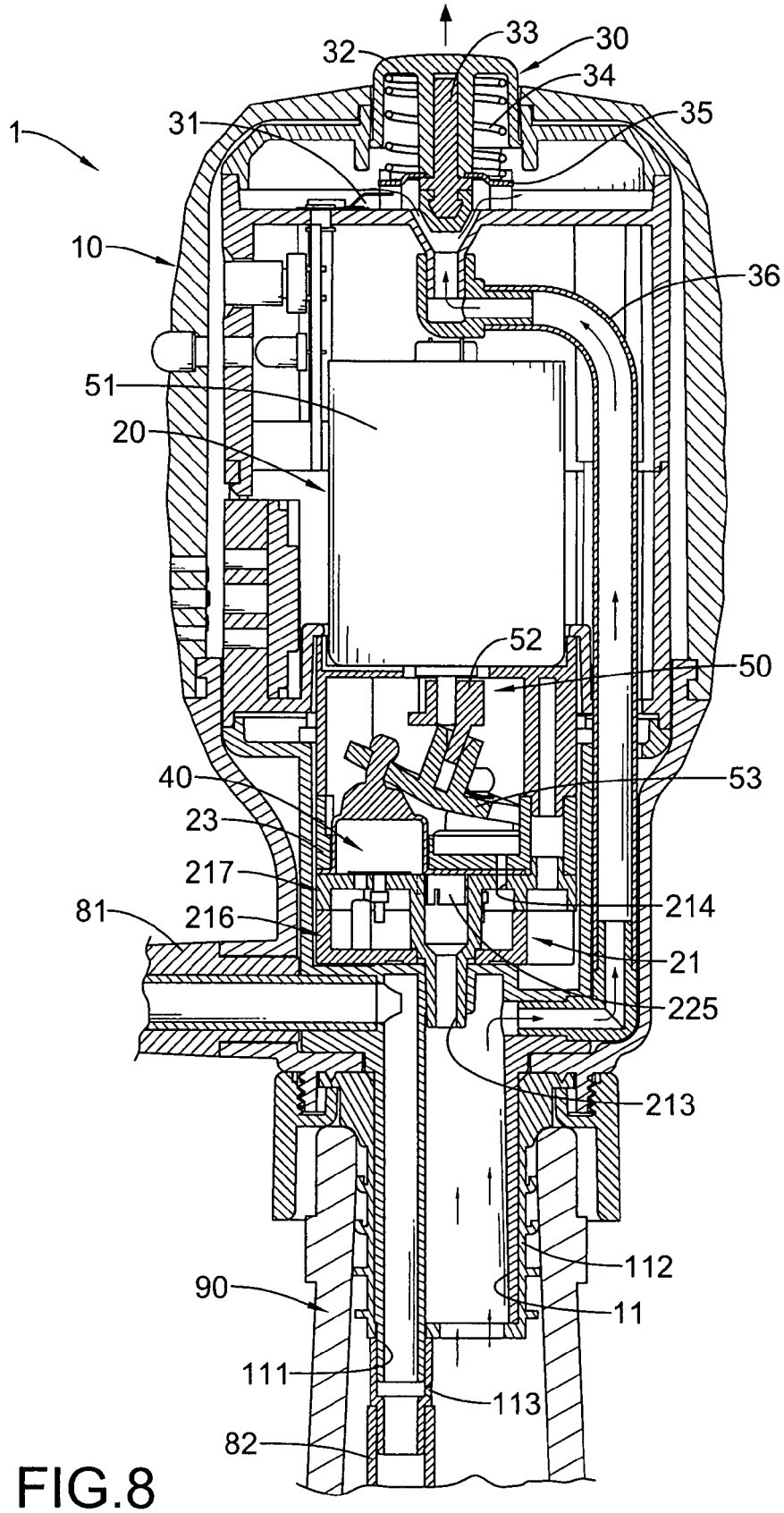
FIG. 8 is an operational cross section side view of the liquid dispenser in FIG. 1 with air pressure being relieved from the container.

The drive device (50) is mounted in the shell (10) over the air pump (22), is connected to and drives the air pump (22) and has a motor (51), a drive head (52) and an oscillator (53). The motor (51) is mounted in the shell (10) above the air pump (22) and has a bottom and a shaft (511). The shaft (511) protrudes rotatably from the bottom of the motor (51). The drive head (52) is connected to the shaft (511) of the motor (51) and has a top, a bottom, a connecting hole and a drive post (521). The connecting hole is formed in the top of the drive head (52) and is connected securely to the shaft (511) of the motor (51). The drive post (521) is formed eccentrically on and protrudes obliquely from the bottom of the drive head (52). The oscillator (53) is connected to the suction caps (221) of the air pump (22), is driven by the drive head (52) and has an oscillating disk (532), a drive tube (531) and multiple connecting holes (533). The oscillating disk (532) is mounted in the shell (10) below the motor (51), connects to the air pump (22) and has a top surface and an outer edge. The drive tube (531) is formed on and protrudes from the top surface of the oscillating disk (532) and is connected rotatably to the drive shaft (521) of the drive head (52). With further reference to FIGS. 6 to 8, the outer edge of the oscillating disk (532) closest to the drive post (521) is forced down and the opposite edge is force up when the drive head (52) rotates to generate an oscillating motion. The connecting holes (533) are formed through the oscillating disk (532) near the outer edge and are mounted respectively around the heads of the suction caps (221) to compress and expand the suction caps (221) and generate a pumping motion.

With further reference to FIG. 5, the power pack (60) is mounted in the shell (10) and is electrically connected to the motor (51) of the drive device (50) of the injection assembly (20) and may have multiple dry-cell batteries (601).

Figure 9:
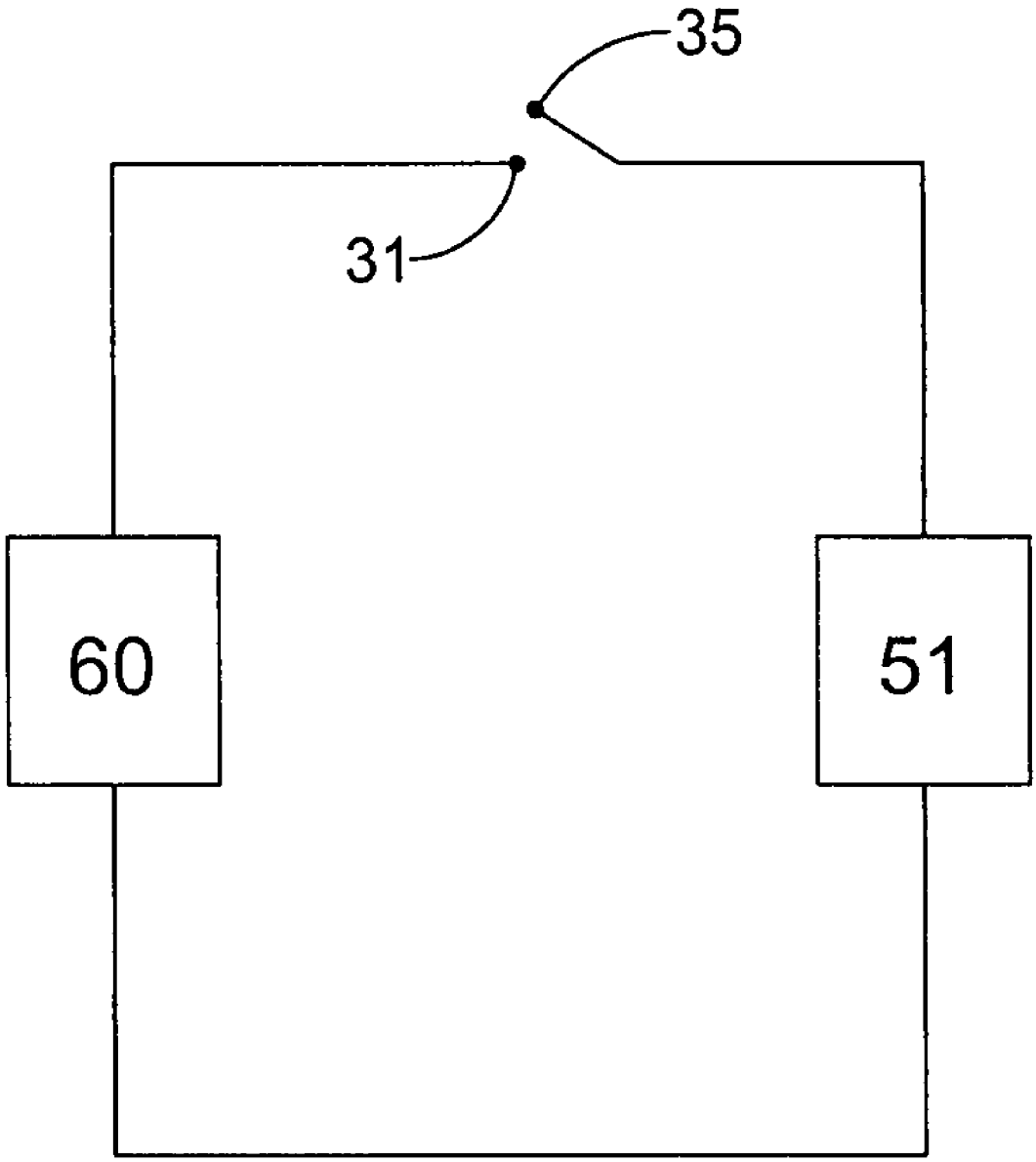
FIG. 9 is a circuit diagram of the liquid dispenser in FIG. 1.

With further reference to FIG. 9, The activating assembly (30) is mounted in the shell (10), is electrically connected to the power pack (60), selectively seals or opens an air passage to the injection tube (11) and has a pressure release tube (36), an optional stationary contact (31), a switch (32), a relief valve disk assembly (33), an optional movable contact (35) and an optional spring (34).

The pressure release tube (36) is mounted in the shell (10), is connected to the injection tube (11) and has an air inlet and an air outlet. The air inlet of the pressure release pipe (36) is connected to the injection tube (1) near the upper end opposite to the spout (81) and communicates with the container (90) through the injection tube (11). The air outlet of the pressure release tube (36) extends to the top end of the shell (10) and has a relief valve seat.

The stationary contact (31) is mounted in the shell (10) and is electrically connected to the power pack (60) and the motor (51).

The switch (32) is movably mounted in and protrudes from the top of the shell (10), activates the injection assembly (20) and has a bottom and a central mounting tube. The central mounting tube is formed on and protrudes from the bottom of the switch (32) and is aligned with and extends toward the relief valve seat on the air outlet of the pressure release tube (36).

The relief valve disk assembly (33) is mounted in and protrudes from the central mounting tube of the switch (32), selectively opens or closes the relief valve seat on the air outlet of the pressure release tube (36) and has a shaft and a valve disk. The shaft is mounted in and protrudes from the central mounting tube of the switch (32) and has a distal end. The valve disk is mounted on the distal end of the shaft, closes the relief valve seat when the switch (32) is pressed to allow air pressure to build up in the container (90) and opens the pressure release tube (36) when the switch (32) is released so air pressure in the container (90) is released immediately.

The movable contact (35) is mounted around the central tube of the switch (32) and selectively abuts the stationary contact (31) when the switch (32) moves downward relative to the shell (10).

The spring (34) is mounted around the central mounting tube of the switch (32) between the bottom and the movable contact (35) to bias the switch (32).

The liquid dispenser as described has the following advantages.

1. To dispense liquid from the container (90), the switch (32) is pushed, which simultaneously closes the pressure release tube (36) and activates the injection assembly (20) that pumps pressurized air into the container (90). The pressurized air presses liquid in the container (90) through the spout assembly (80). Therefore, using the liquid dispenser (1) to dispense liquid is easy and convenient.

2. When the switch (32) is released, pressurized air in the container (90) is released immediately through the injection tube (11) and the pressure release tube (36). This prevent excess liquid from being dispensed from the container (90).

3. The spout (81) is formed on the shell (10) and different sized gaskets (112) can be mounted around the injection tube (11) so the liquid dispenser (1) can be mounted on significantly different sized containers (90).

4. The gas hole (113) allows air to be injected into liquid such as red wine passing through the discharge tube (111).

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A liquid dispenser being mounted in a container having a top, a bottom and a mouth, and the liquid dispenser comprising a shell being hollow, being adapted to be mounted on the mouth at the top of the container and having
- a bottom;
- a top end;
- an injection tube being formed on and protruding longitudinally from the bottom of the shell and having
  - an internal surface;
  - an external surface;
  - an upper end; and
  - a discharge tube being formed longitudinally on the internal surface of the injection tube and having
    - a top end; and
    - a bottom end; and
- multiple air ports being formed through the shell between the bottom and the top end;

a spout assembly being connected to and communicating with the discharge tube of the injection tube and having
- a spout being mounted on and protruding from the shell below the air ports, being connected to and communicating with the injection tube near the upper end and having
  - an inner end being connected to the upper end of the injection tube and communicating with the discharge tube; and
  - an outer end protruding from the shell; and
- a pick-up tube being connected to and extending longitudinally from the bottom end of the discharge tube and having
  - an upper end connecting to and communicating with the discharge tube; and
  - a lower end being open;

an injection assembly being mounted in the shell and pumping air into the injection tube;

a power pack being mounted in the shell and being electrically connected to the injection assembly; and an activating assembly being mounted on the top end of the shell, being electrically connected to the power pack, selectively sealing or opening an air passage to the injection tube and having
- a pressure release tube being mounted in the shell, being connected to the injection tube and having
  - an air inlet being connected to the injection tube near the upper end opposite to the spout and communicating with the container through the injection tube; and
  - an air outlet extending to the top end of the shell and having a relief valve seat;
- a switch being movably mounted in and protruding from the top of the shell, activating the injection assembly and having
  - a bottom; and
  - a central mounting tube being formed on and protruding from the bottom of the switch and extending toward the relief valve seat on the air outlet of the pressure release tube; and
- a relief valve disk assembly being mounted in and protruding from the central mounting tube of the switch, selectively opening or closing the relief valve seat on the air outlet of the pressure release tube and having
  - a shaft being mounted in and protruding from the central mounting tube of the switch and having a distal end; and
  - a valve disk being mounted on the distal end of the shaft, closing the relief valve seat when the switch is pressed and opening the pressure release tube when the switch is released.

2. The liquid dispenser as claimed in claim 1, wherein the injection assembly has a base being connected to the injection tube above the spout and having a lower segment being mounted in the shell against the upper end of the injection tube and having a bottom;

an air chamber being formed in the lower segment; and a central hole being formed through the bottom of the lower segment and corresponding to and communicating with the upper end of the injection tube;

an upper segment being mounted on the lower segment and having a center;

an upper surface;

an outlet tube being formed on and protruding down from the center of the upper segment, extending through the central hole in the lower segment, being mounted in the upper end of the injection tube and having an upper edge; and an inner surface;

multiple ventilating holes being formed through the upper segment around the center; and multiple outlet channels being formed longitudinally in the inner surface of the outlet tube and communicating with the upper edge; and multiple inlet check valves being connected to the upper segment for allowing air to flow from the air chamber and keeping air from flowing back into the air chamber;

an air pump being mounted on the base for pumping air into the container through the injection tube and having a basal disk being mounted on the upper segment of the base and having a center;

a top surface;

a bottom surface; and multiple through holes being formed around the center of the basal disk, corresponding respectively to, being slightly larger than and being mounted respectively over the inlet check valves and having an edge;

multiple suction caps being resilient, being formed respectively on the edges of the through holes of the basal disk and protruding from the top of the basal disk for drawing air from the air chamber when extending and pumping air into the outlet tube when being compressed, and each suction cap having a head; and a compression chamber being formed inside the suction cap and covering a corresponding inlet check valve;

multiple ventilating holes being formed through the basal disk and aligning with the ventilating holes in the upper segment of the base; and an outlet check valve being tubular and resilient, being formed on and protruding from the bottom of the basal disk, corresponding to and being mounted in the outlet tube and having a distal end;

multiple longitudinal slots being formed through the outlet check valve and communicating with the distal end; and multiple curved longitudinal flaps being formed respectively between adjacent longitudinal slots and being mounted respectively over and closing the outlet channels; and a drive device being mounted in the shell over the air pump, being connected to and driving the air pump and having a motor being mounted in the shell above the air pump and having a bottom; and a shaft protruding rotatably from the bottom of the motor;

a drive head being connected to the shaft of the motor and having a top;

a bottom;

a connecting hole being formed in the top of the drive head and being connected securely to the shaft of the motor; and a drive post being formed eccentrically on and protruding obliquely from the bottom of the drive head; and an oscillator being connected to the suction caps of the air pump, being driven by the drive head and having an oscillating disk being mounted in the shell below the motor, connecting to the air pump and having a top surface; and an outer edge;

a drive tube being formed on and protruding from the top surface of the oscillating disk and being connected rotatably to the drive shaft of the drive head; and multiple connecting holes being formed through the oscillating disk and being mounted respectively around the heads of the suction caps.

3. The liquid dispenser as claimed in claim 2, wherein the upper segment of the base further has multiple disk mounting holes, each disk mounting hole being formed through the upper segment between adjacent ventilating holes; and multiple inlet holes being formed through the upper segment in clusters respectively around the disk mounting holes; and each inlet check valve has a neck being mounted in one of the disk mounting holes in the upper segment and having a top end; and a resilient disk, the resilient disks being formed respectively on the top ends of the necks, being mounted against the upper surface of the upper segment and covering the inlet holes.

4. The liquid dispenser as claimed in claim 3, wherein the injection assembly further has a cap frame being connected securely to the upper segment on the air pump and having a bottom panel being mounted on the top surface of the basal disk of the air pump and having a top surface; and multiple mounting holes being formed through the bottom panel and corresponding respectively to and being mounted respectively around the suction caps of the air pump, and each mounting hole having an edge;

multiple mounting rings being formed on the bottom panel respectively around the edges of the mounting holes, protruding up from the top surface of the bottom panel, overlapping the outlet channels of the outlet tube and being mounted respectively around and holding the suction caps; and multiple ventilating holes being formed through the bottom panel and aligning with the ventilating holes of the basal disk.

5. The liquid dispenser as claimed in claim 4, wherein the activating assembly further has a stationary contact being mounted in the shell and being electrically connected to the power pack and the motor; and a movable contact being mounted around the central tube of the switch and selectively abutting the stationary contact when the switch moves downward relative to the shell.

6. The liquid dispenser as claimed in claim 5, wherein the activating assembly further has a spring being mounted around the central tube of the switch between the bottom and the movable contact to bias the switch.

7. The liquid dispenser as claimed in claim 6, wherein the injection tube further has a gasket being mounted around the external surface of the injection tube and pressing against and sealing the mouth of the container; and a gas hole being formed transversely through the discharge tube near the bottom end.

8. The liquid dispenser as claimed in claim 7, wherein the power pack has multiple dry-cell batteries to supply electric power to the drive device.

* * * * *